United States Patent [19]

Ofusa et al.

[11] Patent Number: 4,682,635

[45] Date of Patent: Jul. 28, 1987

[54] METHOD AND APPARATUS FOR MANUFACTURING WOVEN SLIDE FASTENER STRINGER

[75] Inventors: Masaatsu Ofusa, Toyama; Toshio Ishihama, Osaka, both of Japan

[73] Assignee: Yoshida Kogyo K. K., Tokyo, Japan

[21] Appl. No.: 604,376

[22] Filed: Apr. 26, 1984

[30] Foreign Application Priority Data

May 2, 1983 [JP] Japan ..... 58-78034

[51] Int. Cl.[4] ..... D03D 49/50

[52] U.S. Cl. ..... 139/116; 139/118

[58] Field of Search ..... 139/11, 35, 116, 117, 139/118, 384 B

[56] References Cited

U.S. PATENT DOCUMENTS

| | | | |
|---|---|---|---|
| 3,258,034 | 6/1966 | Gerlach | 139/11 |
| 3,480,045 | 11/1969 | Negro | 139/116 |
| 3,692,068 | 9/1972 | Auer et al. | 139/118 |
| 4,127,147 | 11/1978 | Frohlich | 139/116 |
| 4,498,503 | 2/1985 | Ofusa | 139/116 |

FOREIGN PATENT DOCUMENTS

| | | |
|---|---|---|
| 0080167 | 6/1983 | European Pat. Off. . |
| 2137979 | 12/1972 | France . |
| 1044034 | 9/1966 | United Kingdom . |
| 2034767 | 6/1980 | United Kingdom . |

*Primary Examiner*—Henry S. Jaudon

*Attorney, Agent, or Firm*—Hill, Van Santen, Steadman & Simpson

[57] ABSTRACT

A method and an apparatus for manufacturing a woven slide fastener stringer wherein synthetic resin fastener elements in the form of a continuous spiral are formed at the same time that the fastener tape is woven. In the method, the monofilament for forming the fastener elements is advanced toward a hook on one side of warp bunches from the other side thereof, engaged on the hook at the advanced position and guide into a fell via the one side of the warp and is thereafter deformed into a loop shaped fastener element. The apparatus includes a carrier for advancing the monofilament across the warp bunches and a swinging arm swingably positioned at one side of the warp bunches. The swinging arm includes the hook for engaging the monofilament for forming fastener elements and is swingable between a first position wherein the hook is situated at one side of a fell and a second position wherein the hook is remote from the fell. The monofilament is passed through the carrier and is advanced to the position where it engages the hook when the swinging arm is in the second position.

7 Claims, 8 Drawing Figures

METHOD AND APPARATUS FOR MANUFACTURING WOVEN SLIDE FASTENER STRINGER

BACKGROUND OF THE INVENTION

This invention relates to a method and apparatus for manufacturing a woven slide fastener stringer having synthetic resin fastener elements in the form of a continuous spiral. The object of the invention is to provide a method wherein the operation of weaving and securing a synthetic resin monofilament along a side edge of a fastener tape at the same time that the fastener tape is woven and while the monofilament is being formed into fastener elements is capable of being implemented at high speed without being adversely influenced by interference between monofilament hook means and a warp bunch. Another object of the invention is to provide an apparatus having a simple mechanism for practicing the foregoing method.

DESCRIPTION OF THE PRIOR ART

With the known conventional method and apparatus of the foregoing type, a synthetic resin monofilament is wound around a mandrel by using a rotor, or is wound around a flexible mandrel by deforming and driving the mandrel, thereby forming the monofilament into a spirally shaped row of fastener elements. During the forming process, the monofilament is fed into a fell. This well-known arrangement requires such elements as a rotor, mandrel and mandrel support assembly and, hence, is mechanically complex. The arrangement is therefore disadvantageous in that adjustment, maintenance and supervision are difficult to perform.

As disclosed in, e.g., the specification of Japanese patent application Laid-Open No. 9343/74, and in U.S. Pat. No. 4,498,503 there has been proposed a method and apparatus for weaving and securing a spiral fastener element row on a fastener tape while the fastener element row is formed from a synthetic resin monofilament which is supplied as a warp, this being performed without relying upon a rotor, mandrel or the like. However, with the means disclosed in this laid-open specification, the hooked end portion of a latch element traverses the warp rows with seizing the monofilament to perform the movements needed to form the fastener elements. When the latch element is moved at high speed, therefore, there is the danger that the hooked end portion thereof will snag a warp thread other than monofilament undergoing shedding motion. Reducing the size of the hooked portion to lessen the possibility of snagging the warp thread is disadvantageous in that the synthetic resin monofilament may not be seized.

SUMMARY OF THE INVENTION

It is, therefore, a primary object of the present invention to provide a method and apparatus which enable formation of fastener elements with positive seizing of a monofilament and high-speed movement without requiring a rotor, mandrel or the like, and without giving rise to any interference with a warp thread undergoing shedding motion.

According to the present invention, a method of manufacturing a slide fastener stringer is provided wherein a synthetic resin monofilament for forming fastener elements is supplied from a side of warp sheets, or bunches, formed into spiral shaped fastener elements near the fell of a fastener tape and is woven and secured to a side edge of the fastener tape at the same time that the fastener tape is being woven by the warp bunches and filings inserted through the warp bunches, characterized by advancing said synthetic resin monofilament toward a hook on one side of the warp bunches from a source on the other side thereof, engaging the monofilament on the hook at the advanced position, and thereafter guiding the monofilament into the fell via said one side of the warp bunches and forming the monofilament into a loop shaped fastener element.

Also, according to the present invention, an apparatus for manufacturing a slide fastener stringer is provided which comprises a loom equipped with a reed for guiding the warp bunches and a first carrier for inserting a filling, characterized in that a swinging arm having a hook for engaging a monofilament is disposed on one side of the warp bunches, the swinging range of said swinging arm being a region which is at a side of the warp sheets between two defined positions, namely a first position at which the hook is situated at one side of a fell, and a second position at which the hook is situated on one side of the warp sheets and remote from the fell, and in that there is disposed on the other side of the warp bunches in said loom a second carrier through which the synthetic resin monofilament for forming fastener elements is passed, wherein when the hook occupies said second position, said second carrier goes across the warp bunches and advances said monofilament to a position where said monofilament engages said hook.

The method of the present invention, having the constitution and operation described above, cause a synthetic monofilament to be engaged by a hook after the monofilament is advanced to one side of a warp bunch, and introduces the monofilament into a fell via one side of the warp bunch. Accordingly, even if the sheds of the warps are changed immediately after the monofilament is advanced and engaged, movement of the hook engaging the monofilament toward the fell is absolutely not obstructed by the warp bunch. The invention therefore enables a slide fastener stringer to be manufactured at high speed.

In the method of the present invention, the monofilament for forming the fastener elements is preferably received in a guide hole at the distal end of a second carrier at all times so that there is no danger of the monofilament coming off the carrier. Despite high-speed operation, therefore, monofilament feed and engagement by the hook can be performed in reliable fashion.

Moreover, in the method of the present invention in forming the fastener elements, a linear fastener-element forming portion of the monofilament is struck by a forming plate in such a manner that the upper and lower legs of a fastener element are overlapped while a fastener element head portion is supported by a supporting plate. Fastener elements thus can be formed uniformly and reliably.

The apparatus of the present invention, which may be obtained merely by providing a loom with a second carrier and with a swinging arm having a hook, forms a spiral-shaped, continuous fastener element row from a monofilament and both weaves and secures the fastener element row at the fell. The hook will not interfere with a warp bunch even if the hook is large in size. Therefore, the apparatus of the present invention makes it possible to manufacture a high-quality slide fastener stringer at high speed with a mechanism simpler than that of the conventional apparatus.

Many other advantages, features and additional objects of the present invention will become apparent to persons skilled in the art upon making reference to the following description and the accompanying drawings which show preferred embodiments of the present invention by way of illustrative example.

The construction of the invention will now be described with reference to an illustrated embodiment. To facilitate the description, the construction of the apparatus of the present invention will be described first.

Figure 1:
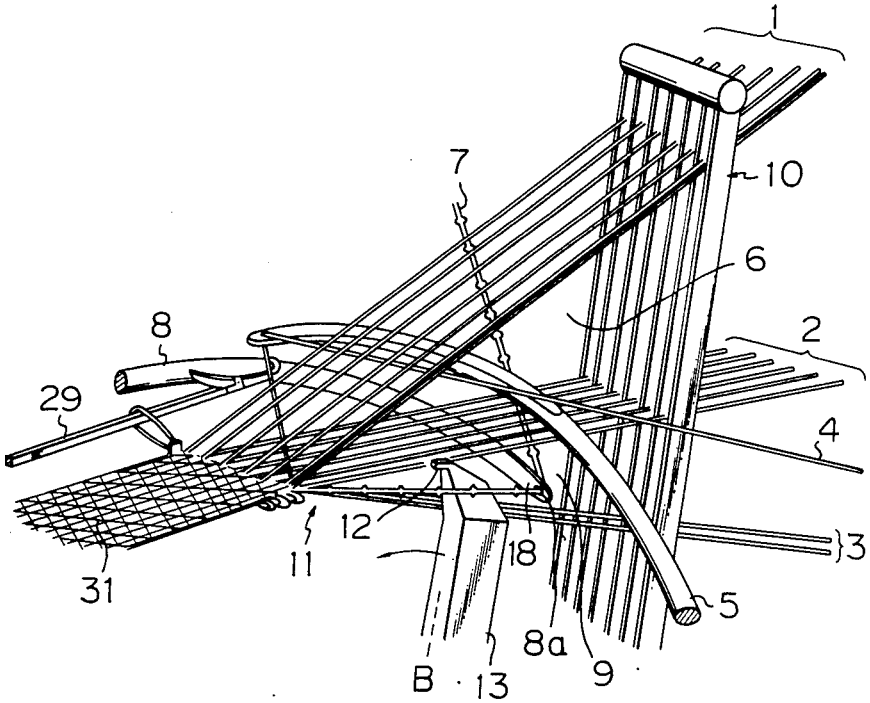
FIG. 1 is a simplified perspective view showing only a principal portion of an embodiment of the apparatus according to the present invention, wherein a swinging arm occupies a second position.
Figure 2:
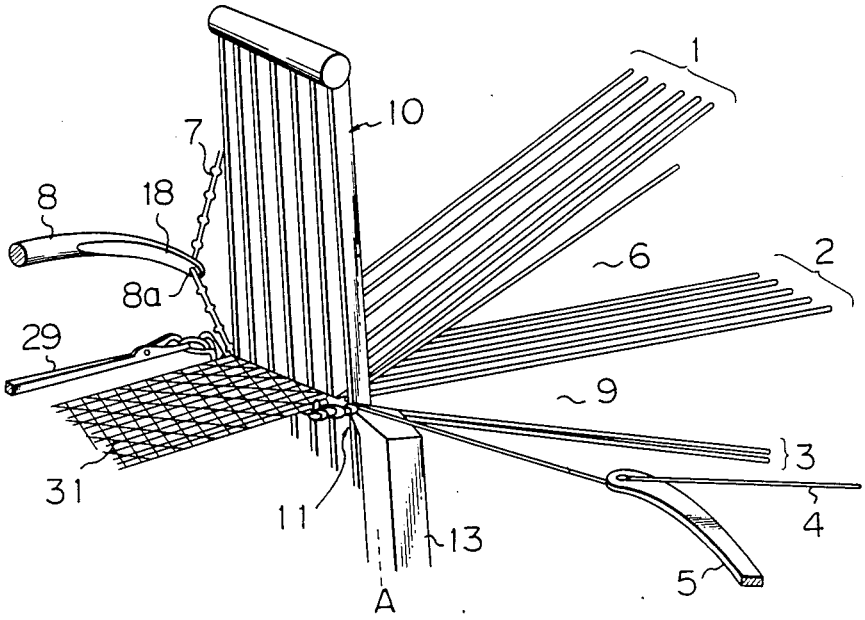
FIG. 2 is a simplified perspective view similar to FIG. 1, wherein the swinging arm occupies a first position.
Figure 3:
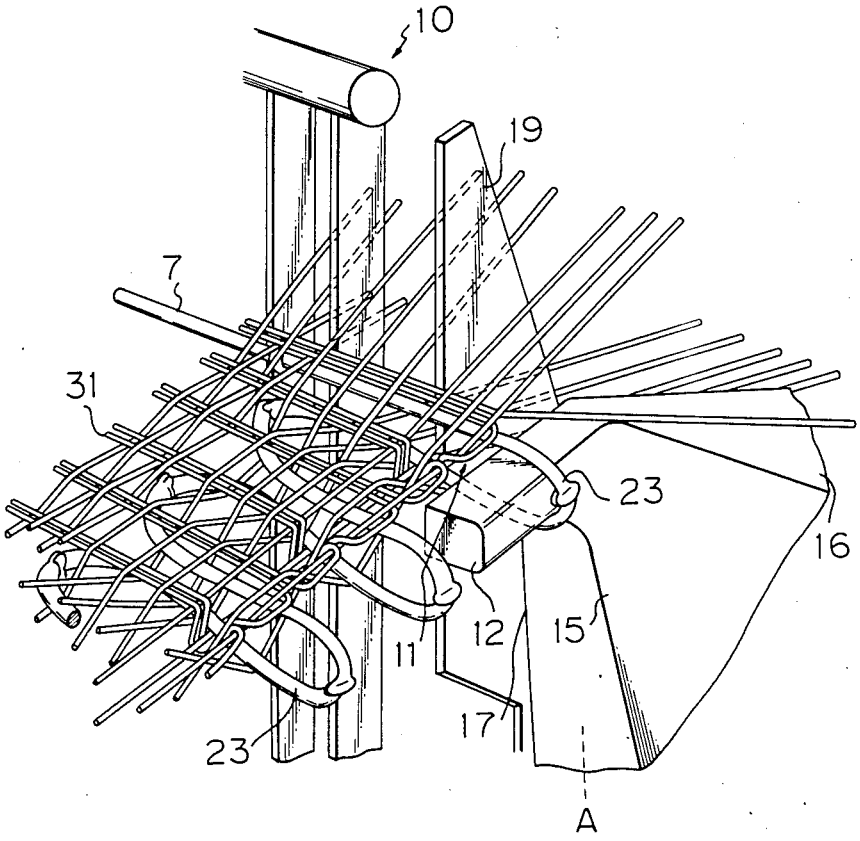
FIG. 3 in an enlarged perspective view showing only a fell portion illustrated in FIG. 2.

As shown in FIGS. 1, 2 and 3, the arrangement is such that a shedding apparatus, not shown, forms upper and lower warp sheets, or bunches 1 and 2 into an upper shed 6 through which a first carrier 5 for introducing a filling 4 undergoes weaving motion, and a lower shed 9 through which a second carrier 8 moves back and forth for advancing a monofilament 7 made of synthetic resin. A reed 10 for guiding the warp bunches 1, 2, 3 is disposed so as to advance and retreat toward a fell 11. The foregoing structure is similar to that of the well-known ribbon loom. Provided on the outer side of the trajectory of the front reed 10, namely on one side of the warp bunches 1, 2, 3, is a swinging arm 13 having a hook 12 on its upper end for hooking and holding the monofilament 7. The swinging arm 13 is so arranged as to be capable of swinging about a shaft, not shown, in a direction similar to that in which the front reed 10 is moved, as illustrated by the arrow. This movement may be seen in copending U.S. Pat. No. 4,498,503, assigned to the same owner.

As shown in FIG. 3, the upper end of the swinging arm 13 is pyramidal in shape, as defined by inclined surfaces 15, 16, 17. The upper end is formed to include the hook 12, having substantially the shape of a square pillar formed by bending the upper end toward the fell 11 and extending in parallel to the warp threads at the fell.

The range over which the swinging arm 13 is capable of swinging is defined by a region outside the warp rows, which region lies between a first positon A, at which the hook 12 is situated at one side of the fell 11, as shown in FIGS. 2 and 3, and a second position B, at which the hook 12 is situated outside the warp sheets 1, 2, 3 and remote from the fell 11, as shown in FIG. 1.

As shown in the drawings, the second carrier 8 has a distal end 18 provided with a guide hole **8*a* through which the monofilament 7 is passed. When the hook 12 is at the second position B, the second carrier 8 is advanced across the warp sheets through the lower shed 9 from the direction opposite the hook 12 to push the monofilament 7 out to one side of the warp sheets 1, 2, 3 between the fell 11 and reed 10 so as to move the monofilament beyond the inclined surfaces 16, 17 of the swinging arm 13. Thus, as shown in FIG. 1, the monofilament 7 is guided to the outer side of the hook 12** and advanced to a position where it may be engaged by the hook.

As shown in FIGS. 3 through 7, a forming plate 19 is secured to one side of the front reed 10, namely to the side facing the hook 12. The forming plate 19 is secured to a holder portion 20 of the front reed 10 by suitable mounting means 21 so as to be positionally adjustable back and forth. The forming plate 19 reinforces the front reed 10 and has a leading edge 22, which is substantially flush with the leading edge of the reed 10, for cooperating with the hook 12 to form a fastener element 23 when a beating operation is performed by the front reed, as will be set forth below.

Figure 5:
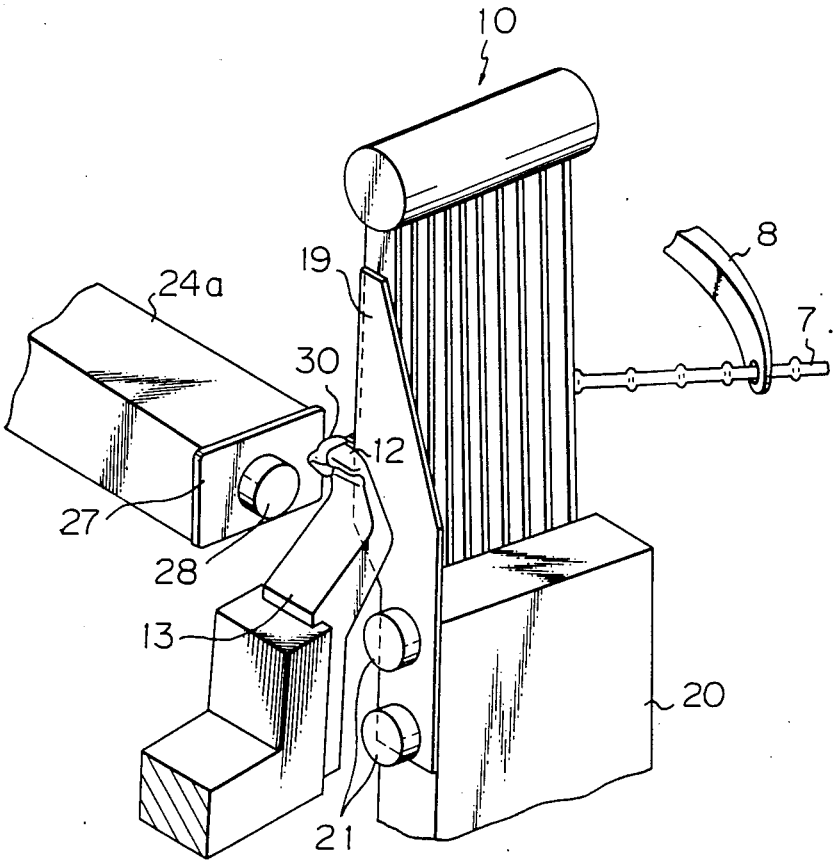
FIG. 5 is a perspective view similar to that of FIG. 4 but shows the conditions existing when a fastener element is formed.
Figure 6:
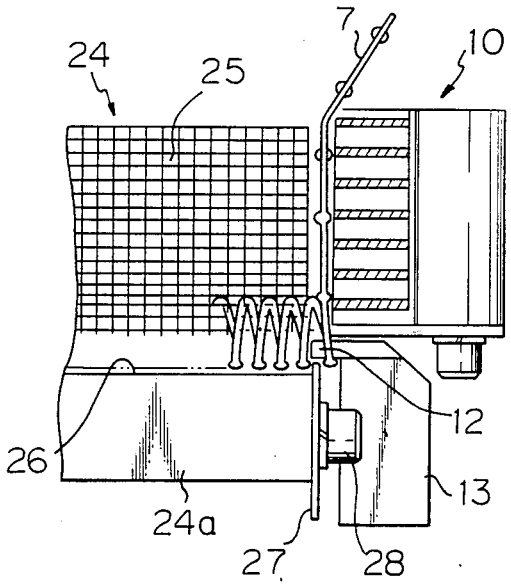
FIG. 6 is a partial plan view showing the positional relationship between a front reed, hook, stringer guide and forming plate when a fastener element is formed.
Figure 7:
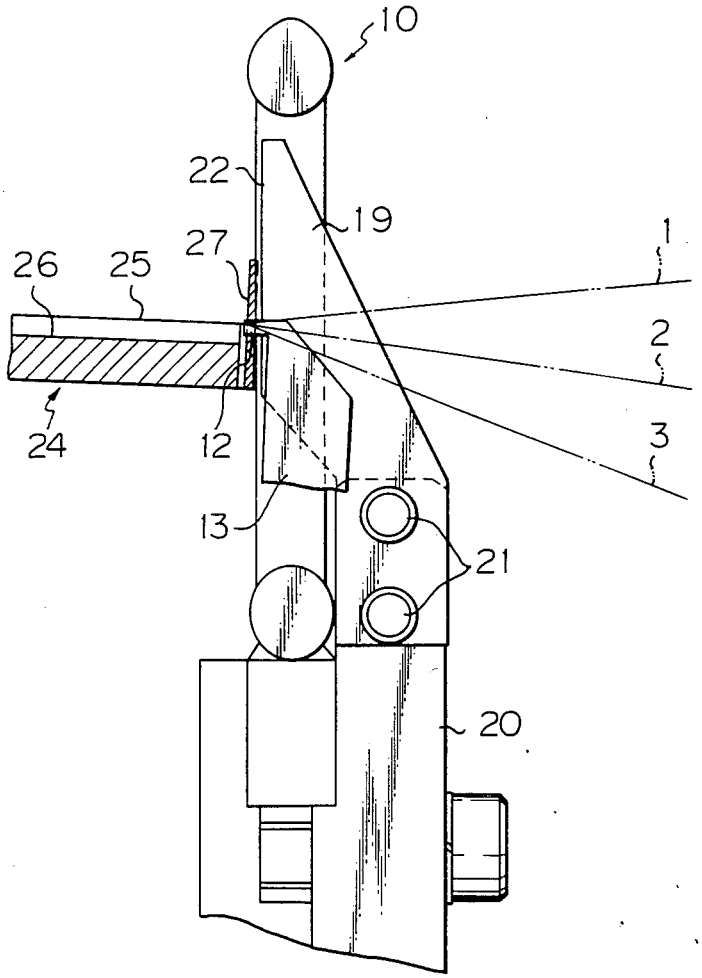
FIG. 7 is a partial side view illustrating the above-mentioned positional relationship, with a portion thereof being shown in section.

As shown in FIGS. 6 and 7, a stringer guide 24 is provided downstream of the fell 11 of the fastener stringer for guiding a fastener stringer formed by the apparatus. The stationary stringer guide 24 includes a tape guide portion 25 and a fastener element guide portion 26. (A chain guide cover plate is not shown.) As shown in FIGS. 4 through 7, a support plate 27, which is oriented substantially at right angles to the direction in which the fastener stringer is guided, is secured by suitable fastening means 28 to the upstream end of the stringer guide 24 on a portion **24*a* thereof, located on the same side as the hook 12. As will be described later, the support plate 27 supports a fastener element head portion to enable smooth forming of the fastener element when the element 23 is formed from the monofilament 27 by the hook 12 and forming plate 19. (In FIGS. 4 and 5, a portion of the stringer guide 24** is deleted from the drawings).

Described next will be the operation of the apparatus having the foregoing construction, as well as the method of the present invention.

The warp sheets 1, 2, 3 passed through the reed 10 are put through a shedding motion by a shedding apparatus, not shown, so as to form the upper shed 6 and lower shed 9. On the other hand, the monofilament 7, which has been passed through the guide hole **8*a* at the distal end of the second carrier 8, is disposed on the side opposite the hook with respect to the fastener tape at a height which is approximately equivalent to the midpoint of the lower shed 9**.

At the beginning of the first cycle of the method according to the present invention, the second carrier 8 is advanced through the lower shed 9 from the side opposite the hook 12 with respect to the fastener tape. With the monofilament 7 still penetrating the distal end 18 thereof, the second carrier is advanced to the side of the hook 12, thereby carrying the monofilament 7 beyond the inclined faces 16, 17 at the upper end of the swinging arm 13 so that the monofilament is guided to a point outside the hook 12.

At the same time, the first carrier 5 is advanced through the upper shed 6 to insert a filling 4 which is seized by a latch needle 29. Thereafter, the first and second carriers 5, 8 are retracted.

This is followed by swinging the swinging arm 13 toward the first position and, at the same time, by advancing the reed 10 toward the fell 11.

Figure 4:
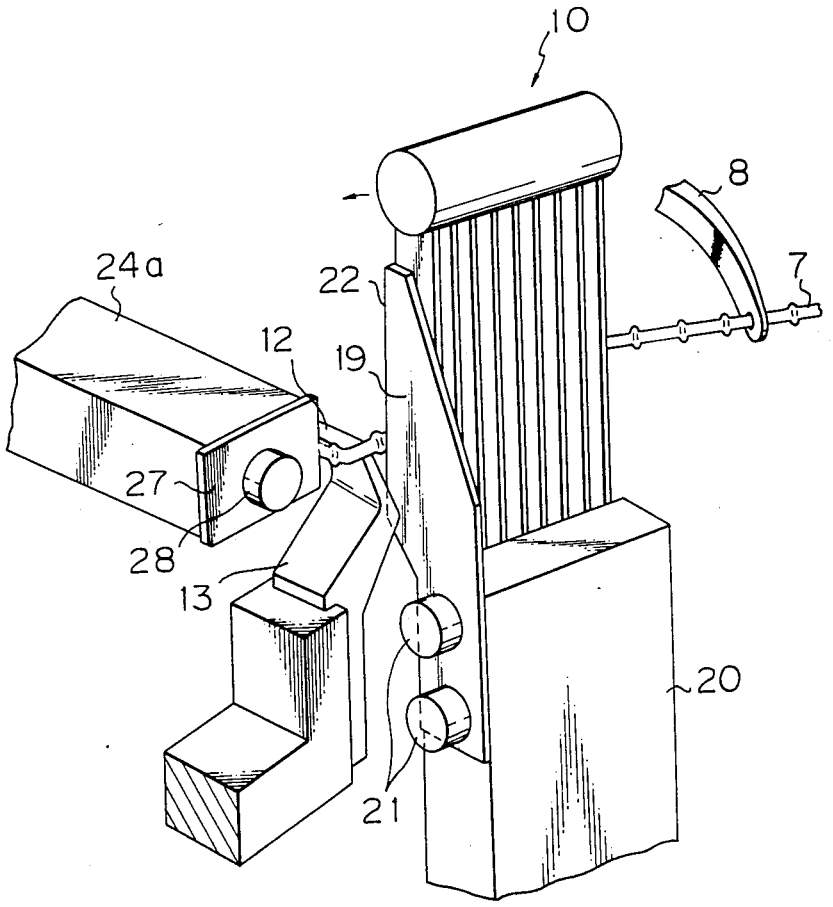
FIG. 4 is a perspective view showing the positional relationship between a monofilament, hook, forming plate and support plate immediately prior to forming of a fastener element.

Owing to these operations, namely the swinging motion of the swinging arm 13 and the beating action of the reed 10, the monofilament 7 is engaged by the hook 12 and, as shwon in FIGS. 5 and 6, a linear portion of the monofilament 7 for forming a fastener element is struck from the horizontal attitude shown in FIG. 4 to the vertical attitude shown in FIG. 5, thereby deforming the monofilament in such a manner that the upper and ower legs of the fastener element are overlapped vertically while the fastener element head 30 is supported by the support plate 27. Thus, as shown in FIG. 3, the monofilament is shaped into a loop thereby to form the fastener element 23.

Upon completion of the beating operation, the swinging arm 13 is left in position, namely in the position shown in FIGS. 2 and 3, the reed 10 is retracted and, at the same time, the sheds of the warp sheets 1, 2, 3 are changed.

Specifically, the positions of the warp sheets 1 and 3 are interchanged, and the warp sheets 2 is moved to the position of the warp sheet 1. Next, a filling is inserted by the first carrier 5, the front reed 10 is advanced agin to beat in the filling, the front reed 10 and swinging arm 13 are subsequently retracted, and the sheds of the warp sheets 1, 2, 3 are returned to the state shown in FIG. 1. This ends one operating cycle of the present invention.

As a result of the foregoing operations, the fastener tape 31 and fastener element 23 are united and secured as shown in FIG. 3.

With the method and apparatus of the present invention as set forth above, the swinging arm 13 for engaging the synthetic resin monofilament 7 and for forming the monofilament into a fastener element is moved solely through a region at the side of the warp sheets 1, 2, 3 which undergo shedding motion. Accordingly, high-speed operation is possible as there is absolutely no interference between the hook 12 of the swinging arm 13 and the warp sheets 1, 2, 3 undergoing shedding motion.

Furthermore, the second carrier 8, which supplies the monofilament 7 from one side of the fastener tape to the side of the hook 12, always has the monofilament 7 passed through the guide hole 8*a* at the distal end thereof, so that there is no possibility of the monofilament slipping off the carrier. As a result, the monofilament 7 may be supplied reliably and engaged by the hook 12 reliably.

In the illustrated embodiment, the monofilament 7 slides on the inclined faces 16, 17 at the upper end of the swinging arm 13 as it is carried beyond the swinging arm by the advancing second carrier 8. With such an arrangement, there is some danger of the monofilament 7 being damaged. Damage to the monofilament 7 may be prevented by adopting an arrangement in which the swinging arm 13 initially is in a lowered attitude from which the arm is raised at the instant that the monofilament 7 is thrust out by the second carrier 8, at which point the monofilament is captured by the swinging arm.

In addition, though the swinging arm 13 is designed to give the optimum mechanical and functional effects by swinging between the first and second positions, other forms of motion may be adopted.

Further, the monofilament 7 employed in the illustrated embodiment has interlocking head portions formed thereon in advance. However, it is possible to use a monofilament in the shape of a simple, round wire to avoid resistance when the monofilament is passed through the guide hole 8*a* at the distal end of the second carrier 8 and form the interlocking head after the monofilament is secured to the fastener tape at the opening for weaving.

Figure 8:
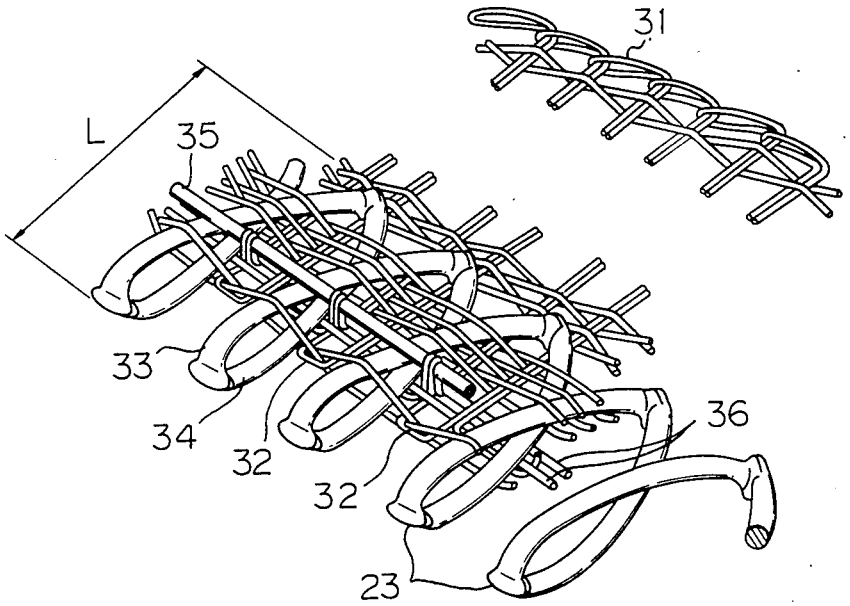
FIG. 8 is an enlarged plan view showing an example of a slide fastener stringer produced by the method and apparatus of the present invention.

One example of a slide fastener stringer obtained by the above-described method and apparatus of the present invention is illustrated in FIG. 8.

In the illustrated example, the row of fastener elements 23 has the form of a continuous spiral. The length L of each fastener element 23 is decided by which of the reed marks formed by the front reed 10 are passed by the warp bunch 3.

Though a filling 32 is inserted two times with double picks by the first carrier for each pitch of the fastener elements 23, it is permissible to insert the filling only one time if the stability of the secured fastener elements allows.

Upper and lower threads 35, 36, under greater tension than the other warps and having a larger diameter, are disposed across the outer surfaces of the upper and lower legs 33, 34 of the fastener elements 23, respectively, thereby assuring the stability of the fastener element pitch.

What is claimed is:

1. An apparatus for manufacturing a slide fastener stringer comprising a loom equipped with a reed for guiding the warp sheets and a first carrier for inserting a filling, characterized in that an arm having a hook for engaging a monofilament for forming fastener elements is swingingly disposed on one side of the warp sheets between two defined positions, namely a first position at which the hook is situated substantially adjacent a fell and a second position at which the hook is situated remote from the fell, and in that there is disposed on the other side of the warp sheets in said loom a second carrier having a guide hole at a distal end thereof through which said monofilament for forming fastener elements is passed and confined from a source on said other side of the warp sheets, wherein the hook occupies said second position, said second carrier goes across the warp sheets and advances said monofilament to a position outside the hook to be engaged by said hook, said reed including a forming plate secured thereto for deforming said monofilament engaged by said hook into said fastener element, and a stringer guide at the downstream end of said fell for guiding the fastener stringer formed by said apparatus, said stringer guide having a support plate at the upstream end thereof for supporting a fastener element head portion when said monofilament is deformed into said fastener element, said support plate being oriented substantially at right angles to the direction in which said fastener stringer is guided.

2. An apparatus for manufacturing a slide fastener stringer comprising a loom equipped with a reed for guiding the warp sheets and a first carrier for inserting a filling, characterized in that an arm having a hook for engaging a monofilament for forming fastener elements is swingingly disposed on one side of the warp sheets between two defined positions, namely a first position at which the hook is situated substantially adjacent a fell and a second position at which the hook is situated remote from the fell, and in that there is disposed on the other side of the warp sheets in said loom a second carrier having a guide hole at a distal end thereof through which said monofilament for forming fastener elements is passed and confined from a source on said other side of the warp sheets, wherein the hook occupies said second position, said second carrier goes across the warp sheets and advances said monofilament to a position outside the hook to be engaged by said hook, wherein said swinging arm is pyramidal in shape defined by inclined surfaces.

3. The apparatus of claim 2, wherein said reed includes a forming plate secured thereto for deforming said monofilament engaged by said hook into said fastener element.

4. The apparatus of claim 3, wherein said apparatus further includes a stringer guide at the downstream end of said fell for guiding the fastener stringer formed by said apparatus.

5. The apparatus of claim 4, wherein said stringer guide includes a support plate at the upstream end thereof for supporting a fastener element head portion when said monofilament is deformed into said fastener element.

6. The apparatus of claim 5, wherein said support plate is oriented substantially at right angles to the direction in which said fastener stringer is guided.

7. The apparatus of any of claims 2, 3, 4, 5, or 6, wherein said hook is formed at the upper end of said swinging arm and has substantially the shape of a square pillar extending in parallel to the warped bunches.

* * * * *